US006566672B1

(12) United States Patent
Schlough et al.

(10) Patent No.: US 6,566,672 B1
(45) Date of Patent: May 20, 2003

(54) LIGHT SENSOR FOR SHEET PRODUCTS

(75) Inventors: James Richard Schlough, Troy, OH (US); Alan Scott Farr, Huber Heights, OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 10 days.

(21) Appl. No.: 09/675,754

(22) Filed: Sep. 29, 2000

(51) Int. Cl.[7] ..... G01N 21/86

(52) U.S. Cl. ..... 250/559.4; 250/559.3; 250/221

(58) Field of Search ..... 250/227.11, 227.28, 250/227.29, 221, 223 R, 234, 559.12, 559.3, 559.4, 206.1, 557, 559.29; 277/3.15, 3.17, 4.02, 4.03; 340/675, 673, 674, 676

(56) References Cited

U.S. PATENT DOCUMENTS 3,728,521 A * 4/1973 Borough et al. ..... 235/488
5,251,888 A 10/1993 Eugster ..... 270/55
5,336,003 A * 8/1994 Nagashima et al. ..... 400/708
5,585,645 A * 12/1996 Goto ..... 250/559.12
5,641,160 A * 6/1997 Saitou et al. ..... 271/292

FOREIGN PATENT DOCUMENTS

| | | |
|---|---|---|
| JP | 10338360 | 12/1998 |
| JP | 1159975 | 3/1999 |
| JP | 1179429 | 3/1999 |

* cited by examiner

*Primary Examiner*—Que T. Le
*Assistant Examiner*—Thanh X. Luu
(74) *Attorney, Agent, or Firm*—Davidson, Davidson & Kappel, LLC

(57) ABSTRACT

An optical sensor for detecting the presence or absence of sheet products in a moveable device has a fixed light source, a fixed light detector spaced from the fixed light source, and a light transfer device fixedly connected to the moveable device for directing light from the fixed light source to the light detector as the moveable device passes by the fixed light source. Also disclosed is a device for transferring and moving sheet products and a method for detecting sheet products by an optical sensor having the steps of inserting a first sheet product into a first moveable device, aligning the first moveable device with a fixed light source and a fixed light detector, and transmitting light from the fixed light source across an opening of the first moveable device.

20 Claims, 2 Drawing Sheets

LIGHT SENSOR FOR SHEET PRODUCTS

BACKGROUND OF THE INVENTION

1. Field of the Invention

The present invention relates generally to sensors for machines with moveable components and more particularly to a device and method for sensing the absence or presence of sheet products.

2. Background Information

Many machines contain moveable components that circulate around the machine continuously. For example, a collating machine is comprised of a plurality of carriages that continuously circulate around an endless loop. Each carriage contains a plurality of pockets. A product from a stationary pile is deposited into each pocket as the carriages circulate.

Collating machines may be useful for properly collating printed products in a specific order. Inserting machines are collating machines in which printed products, such as newspaper sections, are placed within each other. For example, the sheets or sections in a book or newspaper must be in the proper sequence before binding or assembling. The plurality of pockets are arranged at regular distances apart and are moveable along an endless path. Each pocket receives a first product. The pocket then moves downstream and receives a second product. For a collating machine to function properly, the first product must be properly deposited into the pocket before the deposition of the second product. An improperly deposited first product or the failure of depositing the first product will cause downstream errors. These errors include misarranged or missing pages in a book or newspaper or partially deposited products that may cause malfunctions of the collating machine by obstructing movement of the pockets along the endless path.

U.S. Pat. No. 5,251,888, for example, purports to disclose an insetting machine with pockets. No sensors appear to be provided.

Japanese Patent Document Nos. 99-059975, 99-079429 and 98-338360 purport to disclose paper sensing devices but do not appear to address the problem of sensing paper as the paper is located in, or directly enters, moving pockets.

BRIEF SUMMARY OF THE INVENTION

An object of the present invention is to provide a method and device for inserting and sensing a product in a pocket of a collating machine. Another alternate or additional object of the present invention is to provide a method and device for sensing a product on a moving machine while the sensor and the associated electrical power and signal wiring is stationary. A further alternate or additional object of the present invention is to provide a method and device for verifying the proper operation of a moving machine. Yet, a further alternate or additional object of the present invention is to provide a method and device for detecting an obstruction in a moving machine. A further alternate or additional object of the present invention is to allow the use of photodetectors to detect products or machine elements on moving equipment. Yet, a further alternate or additional object of the present invention is to provide a method of using fiber optics and photodetectors to transmit information from a moving platform to a stationary control station.

The present invention provides an optical sensor for detecting the presence or absence of sheet products in a moveable device, the sensor including a fixed light source, a fixed light detector spaced from the fixed light source, and a light transfer device fixedly connected to the moveable device for directing light from the fixed light source to the light detector as the moveable device passes by the fixed light source.

The present invention advantageously permits for reliable and effective device for sensing of products entering a moveable device or for detecting paper jams in the moveable device.

The light transfer device preferably includes a first optical fiber having a first lens attached to a first fiber first end and a second lens attached to a first fiber second end. A second optical fiber may have a third lens attached to a second fiber first end and a fourth lens attached to a second fiber second end.

The first optical fiber and the second optical fiber may be fixed to a top of the moveable device. Preferably, the moveable device is a pocket of an insetting machine. The first lens may be spaced by a distance from the second lens. The first lens and the second lens may be located so as to align with the fixed light source and the fixed light detector as the moveable device passes the fixed light detector and the fixed light source.

The moveable device may have a first opening on a first side and a second opening on a second side of the moveable device. The third lens may be located so as to align through the openings on the first side and on the second side with the fourth lens.

The fixed light detector and the fixed light source are preferably located opposite a conveyor rail conveying the moveable device. The fixed light detector and/or the fixed light source may be connected to a stationary control unit.

The present invention also provides a device for placing products into a moveable device including a plurality of moveable devices and a plurality of optical sensors for detecting the absence or presence of products in the moveable device or for verifying the functioning of the optical sensors.

The present invention advantageously permits for a reliable and effective device for collating, including inserting, products in a moveable device.

The optical sensors include a fixed light detector spaced from a fixed light source by a distance, and a first and a second optical fiber fixedly attached to the moveable device. The first optical fiber may have a first lens attached to a first fiber first end and a second lens attached to a first fiber second end. The second optical fiber may have a third lens attached to a second fiber first end and a fourth lens attached to a second fiber second end.

The moveable device may have a first opening on a first side and a second opening on a second side of the moveable device. The third lens may be located so as to align through the openings on the first side and on the second side with the fourth lens.

The fixed light detector and the fixed light source are preferably located opposite a conveyor rail conveying the moveable device. The fixed light detector and/or the fixed light source may be connected to a stationary control unit.

The invention also provides a method for detecting the absence or presence of products in a moveable device by an optical sensor or for verifying the functioning of the optical sensor including inserting the product into the moveable device of a machine. The moveable device is then aligned with a fixed light source and a fixed light detector. Then, the fixed light is transmitted from the fixed light source. A first optical receiver located on the moveable device then receives the light through a first lens attached to a first fiber first end of the first optical receiver. Then, the light is transmitted through a second lens attached to a first fiber second end of the first optical receiver and across a first opening on the first side of the moveable device. The receipt of the light across a second opening on a second side of the moveable device and through a third lens attached to a second fiber first end of a second optical receiver located on the moveable device is then determined. Then, the receipt of the light through a fourth lens attached to a second fiber second end of the second optical receiver at a fixed light detector is determined. A signal from the optical sensor is then transmitted to a stationary control unit. Then, the signal is processed by the stationary control unit. A plurality of secondary signals is then sent to other controlling modules for the machine.

The present invention advantageously permits a reliable and effective method for sensing products in a moveable device by an optical sensor or for verifying the functioning of the optical sensor. The present invention also advantageously permits a reliable and effective method for verifying the functioning of an optical sensor.

The optical sensor may further detect the absence or presence of products in a second moveable device or may further verify the functioning of a second optical sensor. The moveable device may further align with a second optical sensor to detect the absence or presence of products in the moveable device or to verify the functioning of the second optical sensor.

Preferably, the first optical receiver and second optical receiver are optical fibers.

"Sheet product" as defined herein may include sheets and/or signatures.

BRIEF DESCRIPTION OF THE DRAWINGS

A preferred embodiment of the present invention is described below by reference to the following drawings, in which.

DETAILED DESCRIPTION

Figure 1:
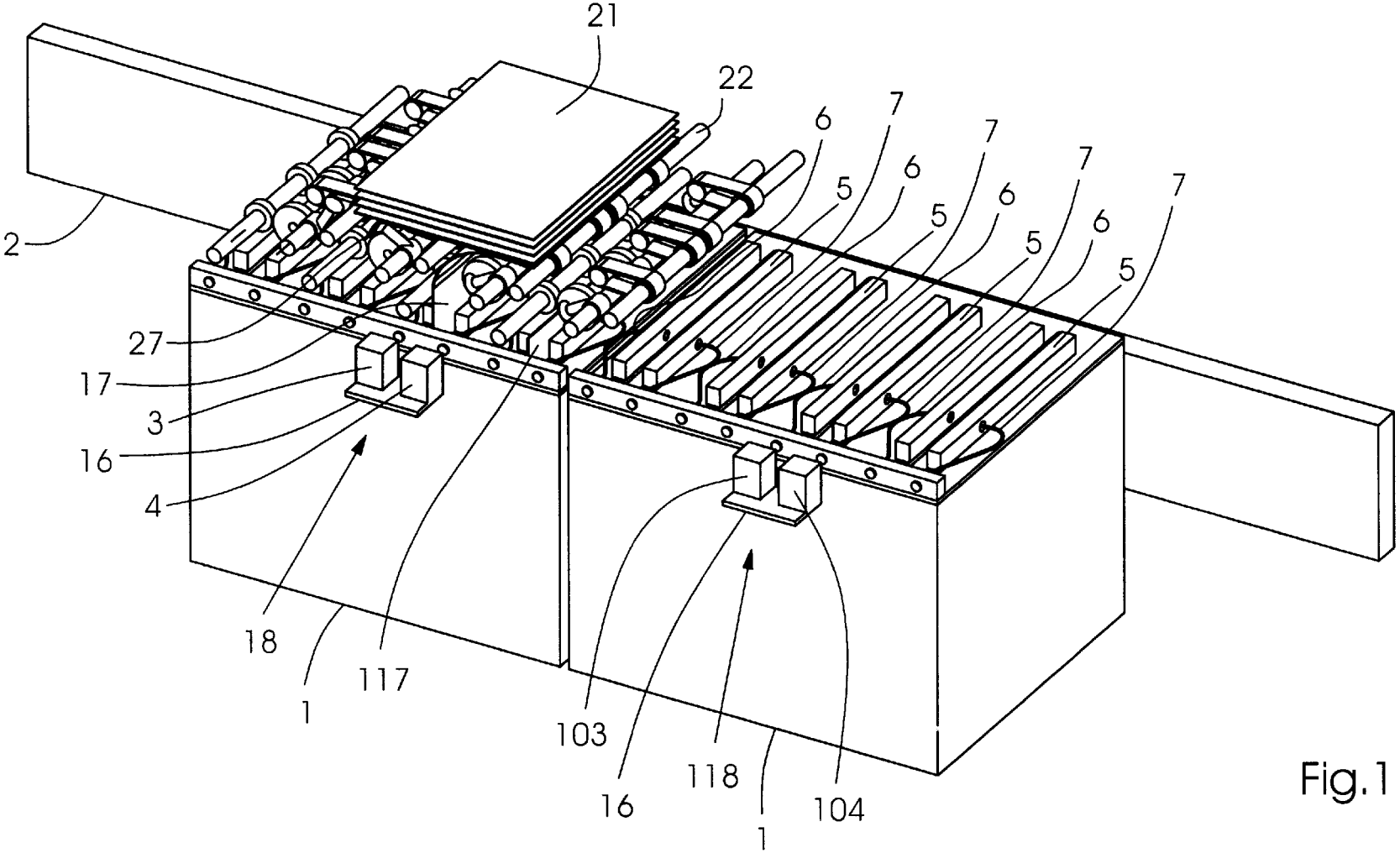
FIG. 1 shows an insetting machine for sensing a product in a moveable device by an optical sensor according to the present invention.
Figure 2:
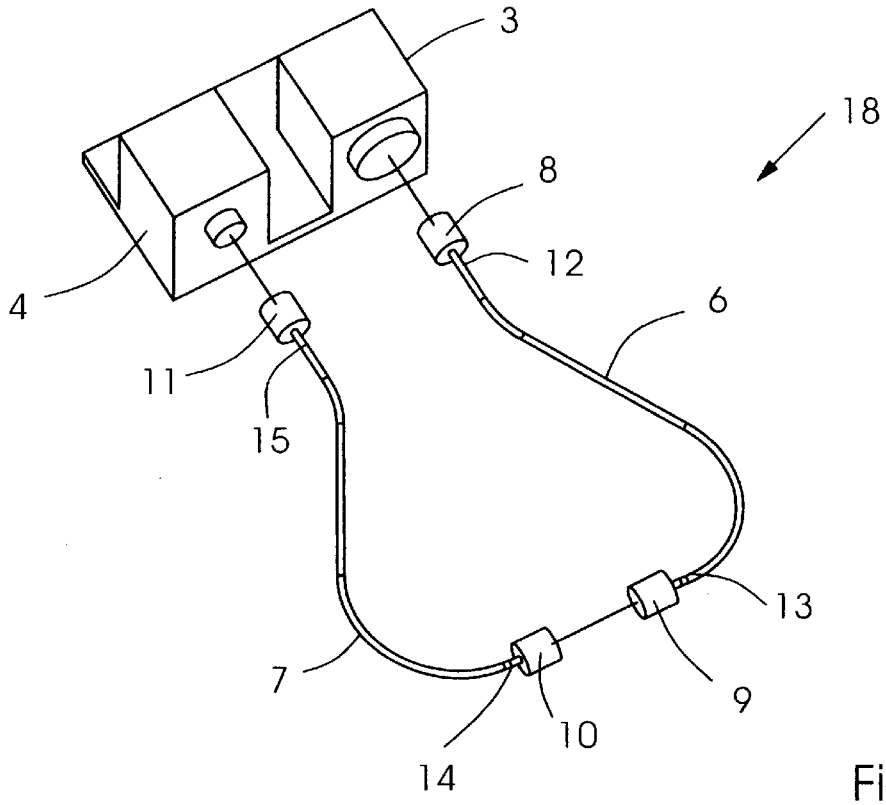
FIG. 2 shows details of the optical sensor of FIG. 1.

As shown in FIG. 1, a moving carriage 1 of an insetting machine is mounted to a conveyor rail 1 and circulates about the machine continuously. An optical sensor 18, as shown in FIG. 2, comprises a fixed light source 3 and a fixed light detector 4. The fixed light source 3 and the fixed light detector 4 are connected by electrical wires to a stationary control unit, for example a microprocessor.

The fixed light source 3 and the fixed light detector 4 are fixedly attached to a frame of the machine in a location adjacent to a pocket 5 of the machine, the pockets 5 being carried by carriage 1. A first optical fiber 6 has a first lens 8 attached to a first fiber first end 12 of the first optical fiber 6 and a second lens 9 attached to a first fiber second end 13. A second optical fiber 7 has a third lens 10 attached to a second fiber first end 14 and a fourth lens 11 attached to a second fiber second end 15. The fibers 6 and 7 are mounted in a fixed fashion on the pocket 5. The first lens 8 and the fourth lens 11 are located on pocket 5 so that the lenses 8 and 11 are directly in line with the fixed light source 3 and the fixed light detector 4 as each pocket 5 passes the light source 3 and light detector 4.

The distance between the first lens 8 attached to the first fiber first end 12 and the fourth lens 11 attached to the second fiber second end 15 and the distance between the fixed light source 3 and fixed light detector 4 thus are identical so that the fixed light source 3 will align with the first lens 8 of the first fiber first end 12 exactly when the fixed light detector 4 aligns with the fourth lens 11 of the second fiber second end 15. As the pocket 5 moves past the fixed light source 3 and the fixed light detector 4 of the optical sensor 18, an optical path is completed and light can travel from the fixed light source 3 to the fixed light detector 4. If no light is sensed, an opening between lenses 9 and 10, which corresponds to top of the pocket opening, is blocked. The sensor 18 thus can determine if products are properly entering the pocket 5.

As shown in FIG. 1, a stack 21 of products can sit above the moving pockets 5 and the products on the bottom of the stack can be transmitted into pockets 5 by a suction device and rollers 22 in known fashion. FIG. 1 shows a product 27 at the bottom of stack 21 being pulled downwardly into pockets 5, product 17 entering the pocket and a product 117 almost fully in pocket 5.

Sensor 18 can thus ensure that product 17 is entering pocket 5, since if the product 17 is not in the opening of pocket 5, fixed light detector 4 detects light as pocket 5 passes fixed light source 3 and fixed light detector 4. If light is detected by sensor 18, a malfunction alarm or signal can be transmitted to an operator or to a control system.

Figure 3:
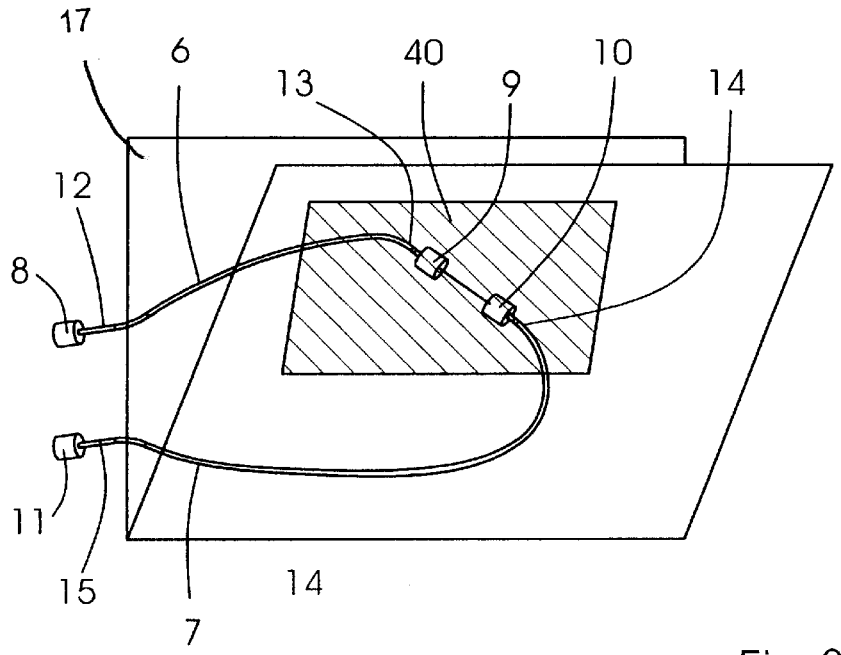
FIG. 3 shows details of the moveable device of FIG. 1.

Thus when product 17 is not present, an optical path is created, as shown in FIG. 2, to allow a light from the fixed light source 3 to loop through first optical fiber 6 and second optical fiber 7 and back to a fixed light detector 4. The optical path has three gaps: between the fixed light source 3 and the first lens 8 attached to the first fiber first end 12 of the first optical fiber 6, in between the second lens 9 attached to the first fiber second end 13 of the first optical fiber 6 and the third lens 10 attached to the second fiber first end 14 of the second optical fiber 7, and between the fourth lens 11 attached to the second fiber second end 15 of the second optical fiber 7 and the fixed light detector 4. At each gap, the lenses 8, 9, 10, 11 on the ends 12, 13, 14, 15 of the optical fibers 6, 7 are used to enhance the transmission of the light. The product 17 to be sensed passes through the gap in between the second lens 9 attached to the first fiber second end 13 of the first optical fiber 6 and the third lens 10 attached to the second fiber first end 14 of the second optical fiber 7, effectively blocking the optical path in a area 40, as shown schematically in FIG. 3.

As shown in FIG. 1, it can be advantageous to provide a second sensor 118 at a location where there should be no product 17 blocking the path, for example the product is already delivered or is located beneath the pocket top. Sensor 118 can be used to verify that the optical fibers and the lenses of pockets 5 are functioning properly. Thus a detector 104 of sensor 118 should always sense light sent by a light source 103. If the sensor 118 does not detect light, it can indicate a problem with the optical fibers or the presence of products at the entrance of the pockets, which may indicate a paper jam.

The sensors of the present invention can also be used to detect the presence of products 17 in the bottom of pockets 5, by placing the optical fibers lower in the pockets 5.

Sensor information can be transmitted to the stationary control unit such as a microprocessor, which can further send a plurality of secondary control signals to alter characteristics of the insetting device or can provide a display or alarm. For example, on detection of a malfunction, the insetting device can be automatically stopped.

While the preferred embodiment operates with optical fibers, it is also possible to transmit the light using other devices such as light pipes or mirrors. "Light transfer device" as defined herein includes any device used to direct light, such as optical fibers, light pipes or mirrors.

What is claimed is:

1. A device for moving sheet products and for detecting the presence or absence of the sheet products being moved comprising:

a moveable device having an opening, a sheet product capable of being held in the opening so as to be stationary with respect to the moveable device, the moveable device being moveable together with the sheet product;

a fixed light source;

a fixed light detector spaced from the fixed light source; and a light transfer device fixedly connected to the moveable device for directing light from the fixed light source across the opening to the light detector as the moveable device passes by the fixed light source so as to detect the presence or absence of the sheet product in the opening.

2. The optical sensor as recited in claim 1 wherein the light transfer device includes a first and a second optical fiber fixedly attached to the moveable device, wherein said first optical fiber has a first fiber first end and a first fiber second end, and the second optical fiber has a second fiber first end and a second fiber second end, the first fiber first end and the second fiber second end being spaced apart by a distance equal to a distance between the fixed light source and the fixed light detector, and the first fiber second end and the second fiber first end being spaced apart by a second distance.

3. The optical sensor as recited in claim 2 wherein the first optical fiber and the second optical fiber are fixed to a top of the moveable device.

4. The optical sensor as recited in claim 2 further comprising lenses attached to the first fiber first end and second fiber second end.

5. The optical sensor as recited in claim 1 wherein the moveable device is a pocket.

6. The optical sensor as recited in claim 2 wherein the second distance corresponds to an opening of the moveable device.

7. The optical sensor as recited in claim 1 wherein the fixed light detector and the fixed light source are located opposite a conveyor rail conveying the moveable device.

8. The optical sensor as recited in claim 1 further comprising a second light transfer device fixedly connected to a second moveable device.

9. A device for moving sheet products comprising:

a plurality of moveable pockets for holding sheet products in an opening so as to be stationary with respect to the moveable device and for moving the sheet products held in the pockets; and an optical sensor for detecting the sheet products as the sheet products enter the pockets, the optical sensor including a stationary light transmitter and light detector, and light transfer devices fixedly attached to the plurality of moveable pockets for directing light from the stationary light transmitter across the opening to the light detector.

10. The device as recited in claim 9 wherein the plurality of pockets includes a first pocket and wherein the light transfer device includes a first and a second optical fiber fixedly attached to the first pocket, the first optical fiber having a first end for interacting with the light transmitter and a second end located at an opening of the pocket.

11. The device as recited in claim 9 wherein each pocket of the plurality of pockets has two fibers of the light transfer device, the two fibers having ends for interacting with the light transmitter and the light detector and other ends located at an opening of the pockets.

12. The device as recited in claim 11 wherein the fibers include end lenses.

13. The device as recited in claim 10 wherein the second optical fiber has a third end and a fourth end, the third end for interacting with the second end across the opening of the pocket and the fourth end for interacting with the light detector.

14. The device as recited in claim 9 further comprising a conveyor rail for conveying the pockets, the light detector and the light source being located opposite the conveyor rail.

15. The device as recited in claim 9 further comprising a second optical sensor for detecting an absence of products.

16. The device as recited in claim 9 further comprising a device for moving the sheet products from at least one stack into the moveable pockets.

17. A method for detecting sheet products by an optical sensor comprising:

inserting a first sheet product into a first moveable device;

moving the first moveable device while the first sheet product is held stationary in the first moveable device so as to transport the first sheet product;

aligning the first moveable device with a fixed light source and a fixed light detector; and transmitting light from the fixed light source across an opening of the first moveable device;

wherein the transmitting step includes receiving the light through a fiber first end of a first optical receiver located on the first moveable device.

18. The method as recited in claim 17 further comprising determining if the light crosses the opening.

19. The method as recited in claim 18 wherein the determining step includes detecting the presence of the light at the fixed light detector.

20. The method as recited in claim 17 further comprising inserting a second sheet product into a second moveable device and aligning the second moveable device with the fixed light source and the fixed light detector.

* * * * *